United States Patent [19]

Stachejko

[11] 4,301,430

[45] Nov. 17, 1981

[54] U-SHAPED IRIS DESIGN EXHIBITING CAPACITIVE REACTANCE IN HEAVILY LOADED RECTANGULAR WAVEGUIDE

[75] Inventor: Vitaly Stachejko, Willingboro, N.J.

[73] Assignee: RCA Corporation, New York, N.Y.

[21] Appl. No.: 186,461

[22] Filed: Sep. 12, 1980

[51] Int. Cl.[3] ..... H01P 1/19; H01P 1/397; H01P 1/00

[52] U.S. Cl. ..... 333/24.1; 333/158; 333/248

[58] Field of Search ..... 333/24.1, 157, 158, 333/248, 253, 208, 212

[56] References Cited

U.S. PATENT DOCUMENTS 2,432,093 12/1947 Fox ..... 333/253 X
3,491,314 1/1970 White .
3,789,330 1/1974 Dixon et al. .
3,825,863 7/1974 Meier ..... 333/253 X
3,906,408 9/1975 Siekanowicz ..... 333/24.1

*Primary Examiner*—Paul L. Gensler
*Attorney, Agent, or Firm*—Samuel Cohen; Robert L. Troike; Robert Ochis

[57] ABSTRACT

Irises which exhibit capacitive reactance in a heavily loaded rectangular waveguide comprise generally U-shaped conductive vanes positioned in the waveguide perpendicular to the length of the waveguide with the opening of the "U" toward a broad wall of the waveguide but spaced therefrom. These irises are effective for increasing the electrical length of ferrite rectangular waveguide phase shifters. These irises may be added to the completed phase shifter to adjust its length by inserting them through previously formed apertures in one of the narrow walls of the waveguide.

9 Claims, 9 Drawing Figures

U-SHAPED IRIS DESIGN EXHIBITING CAPACITIVE REACTANCE IN HEAVILY LOADED RECTANGULAR WAVEGUIDE

The Government has rights in this invention pursuant to Contract No. N00017-70-C-2403 awarded by Department of the Navy.

This invention relates to waveguides and more particularly to irises for rectangular waveguides.

Phase shifters are often used in large numbers in systems such as array antennas. Typical insertion phase shift for a ferrite waveguide phase shifter is about 2000°. In order to obtain the designed performance from such systems all of the phase shifters must produce the same insertion phase shift within a tolerance. This tolerance depends on the specifications for the system. In some systems this tolerance is as small as ±5°—a tolerance of ±0.25% for a nominal 2000° insertion phase shift.

The fabrication of ferrite rectangular waveguide phase shifters has not been refined to the point where all phase shifters are produced with their insertion phase within ±5° of the design value. Most of those not within tolerance (about 90%) are electrically longer than desired while some (about 10%) are electrically shorter than desired.

U.S. Pat. No. 3,789,330 to Dixon et al. discloses decreasing the electrical length of such phase shifters by inserting inductive irises (vanes) into the rectangular waveguide through apertures in one of the narrow walls of the waveguide. (A rectangular waveguide has two wide or broad walls and two narrow walls. The wide walls are sometimes referred to as the top and bottom and the narrow walls are sometimes referred to as the sides of the waveguide.) In order to minimize the Voltage Standing Wave Ratio (VSWR) or mismatch associated with these inductive irises, Dixon et al. teach using them in sets of two or three (pairs or triplets) with each member of the set spaced about one quarter wavelength from its nearest neighbor within the set.

If one set (pair or triplet) of inductive irises does not provide sufficient phase shift to bring the insertion phase of a phase shifter within the predetermined tolerance of the design value, then one or more additional sets of inductive irises may be used in order to bring the phase shifter within tolerance. When two or more sets of irises are used, the last iris of one set and the first iris of the next set are preferably about ⅜ wavelength apart—see column 3, lines 11–23 of the Dixon et al. patent. The Dixon et al. patent is incorporated herein by reference.

The technique of Dixon et al. is successful in salvaging (compensating) almost all of the 90% of phase shifters which are initially electrically too long (have too much insertion phase). However, this technique does nothing to salvage (compensate) the 10% of phase shifters which are initially electrically too short (have too little insertion phase), since they need to increase their insertion phase rather than reduce it. Discarding this 10% of phase shifters is extremely expensive since such phase shifters typically cost about $200 each and some typical systems may use many thousands of them.

The use of capacitive irises would be expected to be effective for increasing the electrical length of the 10% of the phase shifters which are too short. However, classical capacitive irises are ineffective for that purpose since in this type of ferrite phase shifter they exhibit inductive reactance in that they make the phase shifter electrically shorter. The reasons for this are not known, but are believed to relate to the heavy loading of the waveguide which concentrates most of the electric field (>70%) within the ferrite and may also involve resonance effects.

In consequence, an iris design is needed which will exhibit capacitive reactance in a heavily loaded waveguide.

In accordance with one embodiment of the present invention, a generally U-shaped electrically conducting iris is inserted in a rectangular waveguide. The iris has a pair of legs spaced by a gap. At one end the legs merge in to a base portion. The waveguide includes a pair of parallel broad walls spaced by a pair of parallel narrow walls. The iris is positioned in the waveguide with the legs extending parallel to the narrow walls and the base extending parallel to the broad walls. The ends of the legs distant from the base are spaced from the broad walls.

Figure 5:
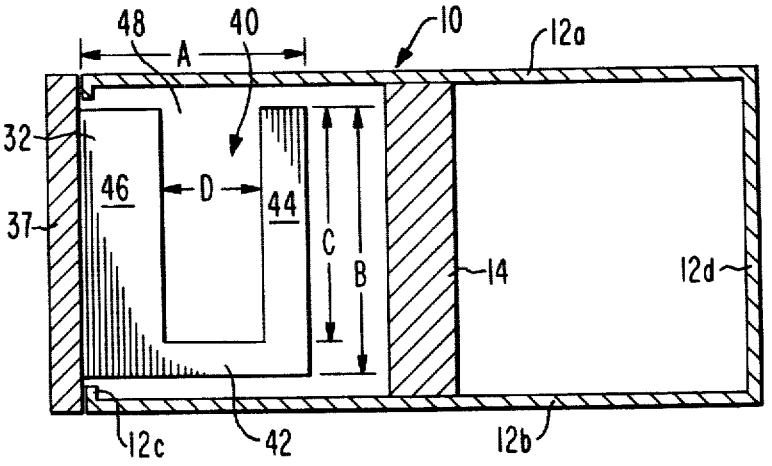
Figure 6:
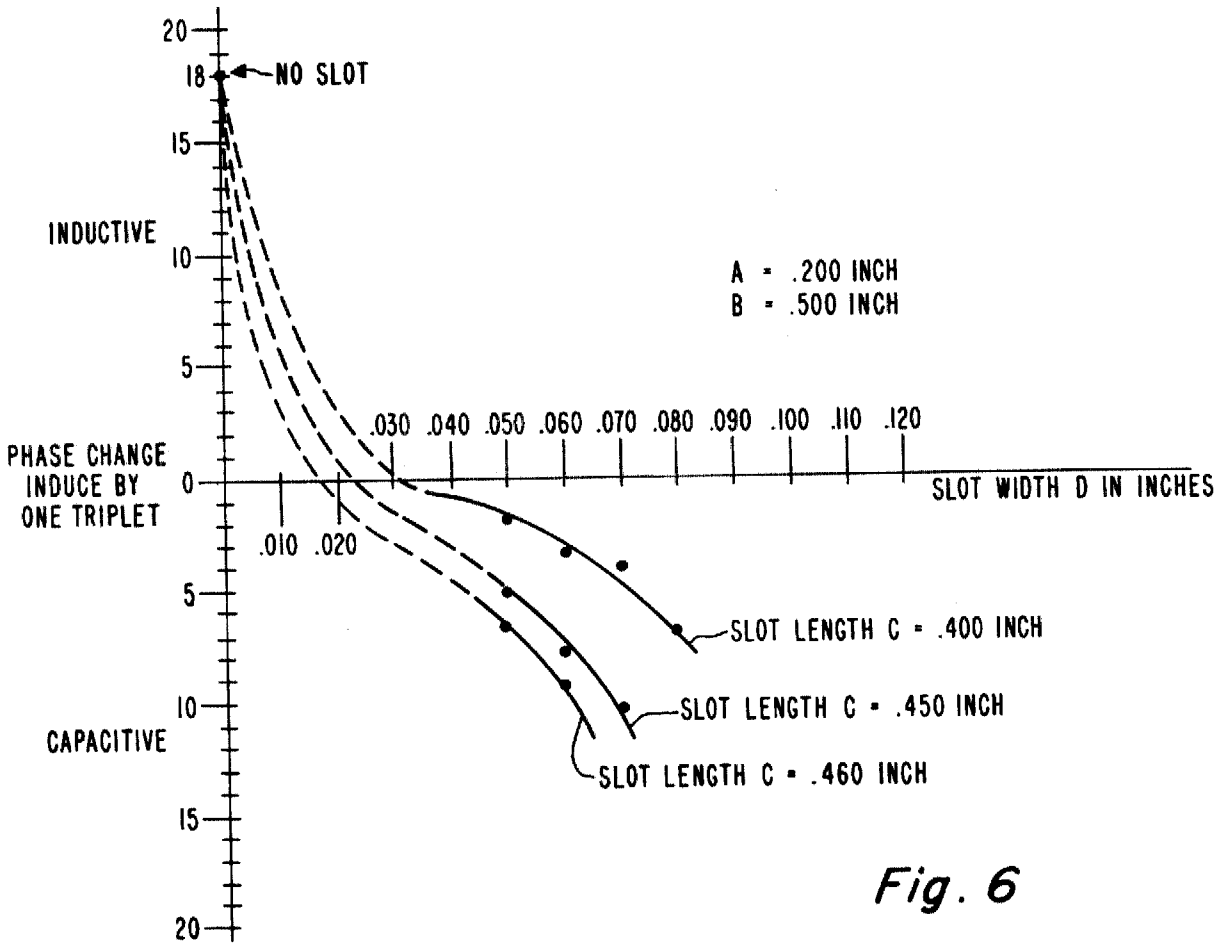

FIGS. 4*a*, 4*b*, 4*c*, and 4*d* illustrate four other iris configurations which exhibit inductive reactance in heavily loaded rectangular waveguides;

FIG. 5 illustrates an iris in accordance with this invention mounted in a heavily loaded rectangular waveguide;

FIG. 6 is a graph illustrating the dependence of the phase shift induced by the iris of FIG. 5 on the dimensions of the slot in the iris.

Figure 1:
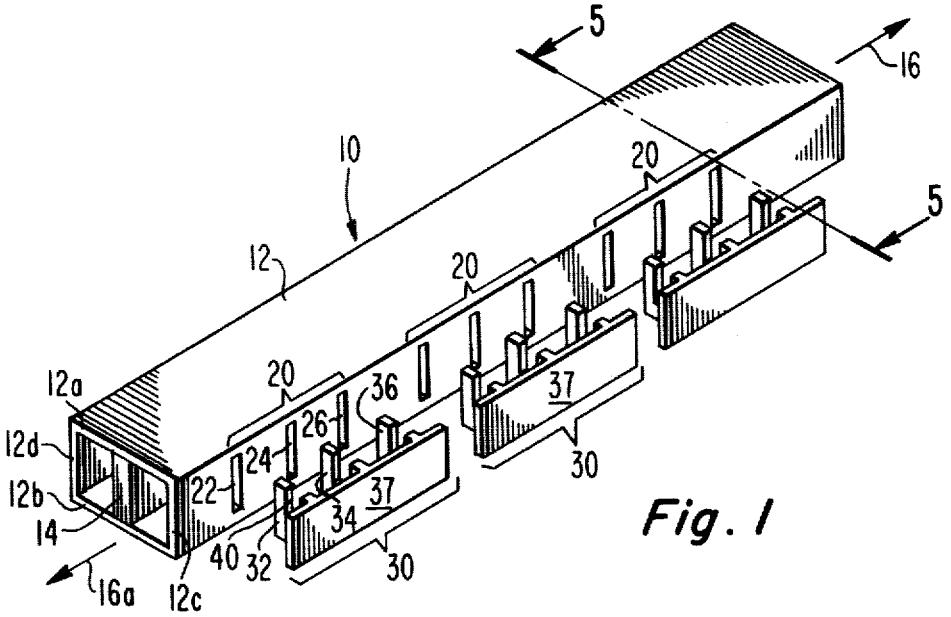
FIG. 1 illustrates in perspective a phase shifter and irises in accordance with the invention.
Figure 2:
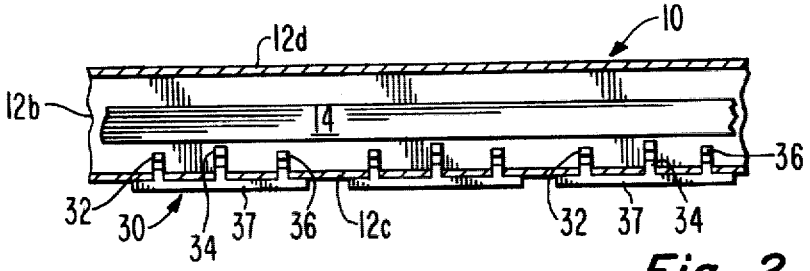
FIG. 2 is a top plan view of the phase shifter of FIG. 1 with the irises in place and with the top broad wall removed.

FIGS. 1 and 2 illustrate a plurality of irises in accordance with the invention and a phase shifter 10 with which they are effective for inducing a capacitive reactance. The phase shifter 10 includes a rectangular waveguide 12 defined by a pair of oppositely disposed parallel broad walls 12*a* and 12*b* which are spaced by a pair of oppositely disposed parallel narrow walls 12*c* and 12*d*. The waveguide in this embodiment is loaded by a rectangular body 14 of ferrite extending between the broad walls 12*a* and 12*b* and along a portion of the length of waveguide 12. The body 14 is preferably centered between the narrow walls 12*c* and 12*d*.

In other circumstances the waveguide may be loaded by other dielectric materials or by a ridge extending from one or both of the broad walls and so forth. For purposes of this specification a waveguide is considered heavily loaded if 70% of the electric or E field is located in the central ⅓ of the waveguide's broad dimension.

As is well known, a guided wave in a rectangular waveguide propagates along the length of the waveguide in the direction 16 or 16*a*.

The phase shift introduced by the phase shifter 10 to signals propagating along the length of the waveguide is controlled by an external D.C. magnetic field applied to the ferrite 14 as is well known in the art. There are three sets 20 of apertures 22, 24, and 26 in one of the narrow walls (wall 12*c*) of the waveguide 12 positioned for the insertion of sets (triplets) of irises for adjusting the electrical length of the phase shifter. The spacing of the apertures 20 is in accordance with that described in the cited Dixon et al. patent, e.g., each aperture of a set is a prescribed distance (which is about one quarter wavelength at an operating frequency of the waveguide) from its nearest aperture and each set (triplet) is spaced a prescribed distance which is about $\frac{3}{8}$ of a wavelength at that frequency from the adjacent set. The irises are disposed in sets 30 of three irises 32, 34 and 36 which are spaced from each other by the same distance as their associated apertures 22, 24 and 26, respectively. This spacing is established by a bar 37 to which the irises are preferably fixed. Bar 37 and irises 32, 34 and 36 are preferably aluminum and may be a single integrally formed piece. These triplets may be formed by machining triplets having solid rectangular vanes, but are preferably formed with the slots 40 initially present.

Figure 3:
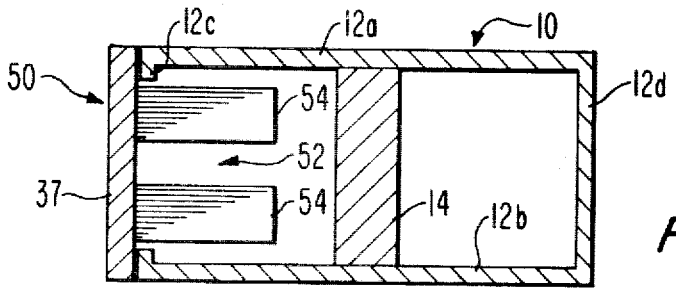
FIG. 3 illustrates a classical capacitive iris positioned in a rectangular waveguide.

In FIG. 3, a classical capacitive iris 50 having a slot 52 disposed parallel to the broad walls 12*a* and 12*b* of the waveguide 12 and extending from the edge 54 of the iris nearest the body 14 to wall 12*c* is illustrated in a cross-section of waveguide 12. In accordance with classical theory, this iris configuration would be capacitive in a non-loaded waveguide. This iris configuration was initially tried in an attempt to increase the length of the "too-short" phase shifters. However, contrary to expectations, this type of iris exhibits inductive reactance rather than capacitive reactance in the phase shifter 10 in that it reduces the electrical length of the phase shifter. Consequently, in a heavily loaded waveguide phase shifter, this type of iris is ineffective for the purpose of increasing the electrical length of the phase shifter.

Figure 4A:
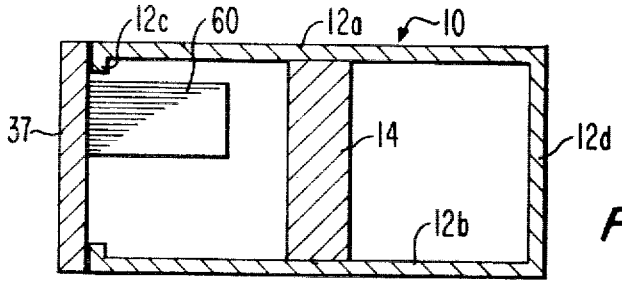
Figure 4B:
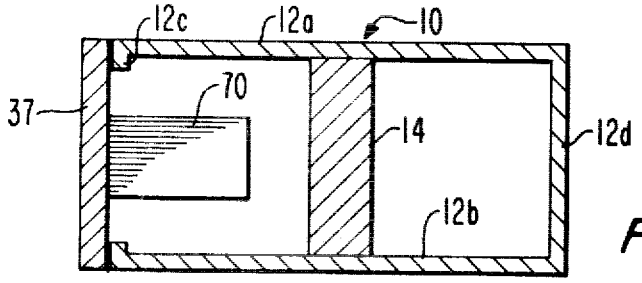
Figure 4C:
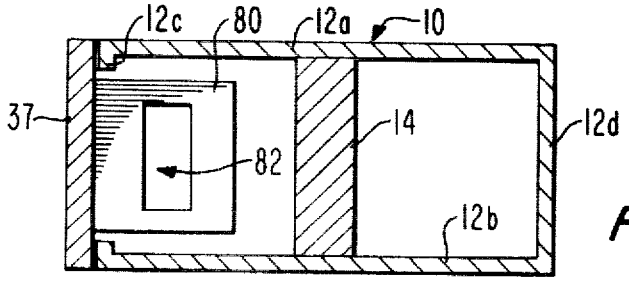
Figure 4D:
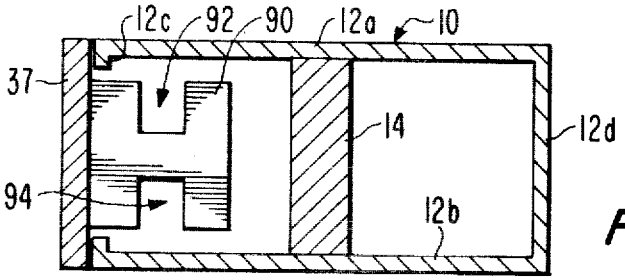

The iris configurations illustrated in FIGS. 4*a*, 4*b*, 4*c* and 4*d* were tried in an attempt to develop an iris configuration which would exhibit capacitive reactance. Each of these configurations is also ineffective for increasing the electrical length of the ferrite phase shifter. In FIG. 4*a*, a single vane 60 extends into only the top half of the waveguide 12. In FIG. 4*b*, a single vane 70 extends into only the middle portion of the narrow dimension of the waveguide. Classically this is a capacitive iris. In FIG. 4*c*, the iris 80 is a closed loop configuration with an elongated aperture 82 within the iris extending parallel to narrow wall 12*c* and where the loop does not contact either broad wall of the waveguide. This iris was identical in effect to one of the same dimensions without any aperture to within 0.1° of phase shift. In FIG. 4*d*, the iris 90 extends substantially from broad wall 12*a* to broad wall 12*b*, but does not contact either broad wall. Iris 90 has an H configuration having two in-line slots 92 and 94 with slot 92 having its open end adjacent to broad waveguide wall 12*a* and slot 94 having its open end adjacent to broad waveguide wall 12*b*. Each of these iris configurations is effectively inductive in that each of them decreases the electrical length of the phase shifter. Each of the irises of FIGS. 3 and 4 was fabricated by machining a triplet of irises like those of FIG. 1 except that initially each of the vanes was a solid rectangle.

In FIG. 5, an iris 32 in accordance with the present invention is illustrated in a cross-section of waveguide 12 taken along lines 5—5 of FIG. 1. This iris is a flat, electrically conductive member and extends substantially the entire distance between broad walls 12*a* and 12*b* of the waveguide, however, preferably without contacting either of these walls. An elongated slot or gap 40 extending generally parallel to narrow wall 12*c* makes the iris essentially U-shaped with an inner upright or "leg" 44, an outer upright or "leg" 46, a connecting base 42 at one end of the legs and an open or gap end 48 at the other end of the pair of legs. As illustrated in FIG. 5, the iris constitutes a rectangular U since its outline lies along the perimeter of a rectangle and the edges of its legs bounding the open part of the U merge with its base at right angles. The lack of electrical contact between the broad wall 12*a* and the gap end 48 of the iris is crucial to obtaining capacitive reactance since contacting both the inner leg 44 and the outer leg 46 to the broad wall 12*a* causes the iris to exhibit inductive reactance like iris 80 of FIG. 4*c*. The lack of contact between the broad walls and base 42 is not critical to waveguide performance but is an important difference from some classical iris configurations in that it makes post fabrication adjustment feasible at a stage where soldering or other contact assuring procedures are difficult or impossible to perform. Consequently, for waveguide uniformity of an individual waveguide over time and from one waveguide to another, the irises are preferably specifically designed to avoid contact between the base 42 and the adjacent broad wall. Preferably the separation between the base and the adjacent broad wall is the same as the separation between the other broad wall and the gap ends of the legs 44 and 46.

A single iris of this configuration induces a capacitive reactance when inserted in the waveguide. However the use of triplets is preferred to minimize the mismatch and maximize the amount of phase shift obtainable.

For S band (2.5–4 GHz) use, the rectangular hollow or cavity formed by the walls 12*a*, 12*b*, 12*c* and 12*d* of the heavily loaded waveguide 12 of phase shifter 10 is preferably 0.778 inch (19.76 mm) wide (broad dimension) by 0.570 inch (14.48 mm) high (narrow dimension). The inventive iris has general dimensions of extending into the waveguide a distance A parallel to the broad walls (12*a* and 12*b*) and having an extent B parallel to the narrow walls 12*c* and 12*d*. The slot 40 has a length C parallel to the narrow walls which is less than B and a width D parallel to the broad walls less than A. The length C is also the length of the legs 44 and 46. The width D is also the length of the gap between the legs at the open end of the U. The slot 40 is preferably centered within the portion of the dimension A which is within the hollow of the waveguide 12, thereby making the width of leg 44 equal to the width within the waveguide of leg 46. Leg 46 will actually be wider than leg 44 under these conditions to allow for the thickness of the wall 12*c*. For the above waveguide, the dimension A (penetration into the waveguide) is preferably between 0.100 inch (2.54 mm) and 0.250 inch (6.35 mm) and the dimension B (height of the iris) is preferably between 0.400 inch (10.16 mm) and 0.520 inch (13.2 mm), with dimension D (width of the slot or length of the gap) preferably between 0.040 inch (1.02 mm) and 0.100 inch (2.54 mm) and dimension C (the length of the slot or legs) preferably between 0.350 inch (8.89 mm) and 0.470 inch (11.93 mm). Further increases in the dimensions C, D and/or A increase the capacitive effect of the iris. However, increasing C makes the capacitive effect overly sensitive to fabrication tolerances; increasing C or D compromises the mechanical integrity of the iris and increasing A brings the iris too close to the ferrite—a condition which can impair system reliability.

For 10 degrees phase shift per triplet in the above phase shifter waveguide, the preferred dimensions of the irises are:

| irises 32 and 36 | iris 34 |
|---|---|
| A = .183 inch | A = .200 inch |

-continued

| irises 32 and 36 | iris 34 |
|---|---|
| B = .500 inch | B = .500 inch |
| C = .450 inch | C = .450 inch |
| D = .070 inch | D = .070 inch |

The dimension A of iris 34 is made longer than dimension A of irises 32 and 36 in order to minimize the mismatch and thus VSWR associated with the insertion of the iris set into the waveguide.

The phase shift introduced into the phase shifter 10 by each triplet 30 of irises 32, 34 and 36 (constructed as illustrated in FIGS. 1 and 5) is illustrated graphically in FIG. 6 as a function of the dimension D (slot (or gap) 40 width) with a dimension C (slot or leg length) as a parameter, where these dimensions are illustrated in FIG. 5. It will be observed that as the dimension C and/or D approaches zero, the capacitive effect decreases and the iris will become inductive. The phase value at zero slot-width is established by the values obtained using solid irises of the same size. The dashed portions of the curves (which extend from the solid portions of the curves which are determined by measured data to the zero slot-width value) are projected on an assumption of smooth curves.

The spacing between successive ones of the apertures 22, 24 and 26 (FIG. 1) is not ideal for the use of capacitive irises since these spacings were selected for use with inductive irises. The VSWR (voltage standing wave ratio) associated with each triplet is minimized by adjusting the dimension A of irises 32 and 36, FIG. 1. The spacing between successive triplets 30 is also non-ideal for capacitive irises. However, the resulting VSWR increase (by a factor of 1.015 per triplet) is small enough that it does not adversely affect the system in which the phase shfiter is used.

In accordance with the invention, an iris which acts capacitively in heavily loaded waveguides has been illustrated and described. This iris can also be used in less heavily loaded and non-loaded waveguides. Irises of this configuration may be permanently mounted in a waveguide if desired. Those skilled in the art will be able to make other modifications to the configuration, dimensions and positioning of the irises without departing from the scope of the invention as claimed in the appended claims.

What is claimed is:

1. In combination:

an elongated rectangular waveguide adapted for propagating waves along its elongated axis and comprising a pair of oppositely disposed, parallel broad walls spaced by a pair of oppositely disposed, parallel relatively narrower walls;

a substantially U-shaped electrically conductive iris being oriented transverse to said elongated axis and having a base and a pair of substantially parallel legs each having a first end and a second end, said first ends of said legs merging into said base and said legs spaced apart at their second ends by a gap, said iris positioned in said waveguide with said legs extending parallel to said narrower walls and with said base extending parallel to said broad walls, said iris being further dimensioned and positioned so that said second ends of said legs are spaced from said broad walls.

2. The combination recited in claim 1 wherein said iris is substantially a rectangular U.

3. The combination recited in claim 1 wherein said legs are of equal width within the waveguide.

4. The combination recited in claim 1 wherein:

the width of the gap between the legs is between 0.04 inch and 0.1 inch; and the length of said legs from their first end to their second end is between 0.35 and 0.47 inch.

5. The combination recited in claim 1 wherein said waveguide is heavily loaded.

6. The combination recited in claim 5 wherein said waveguide comprises a ferrite phase shifter and said loading is induced by the body of ferrite material within the ferrite phase shifter.

7. The combination recited in claim 6 wherein:

said broad walls of said waveguide are substantially 0.778 inch wide;

said narrow walls of said waveguide are substantially 0.570 inch wide;

said iris is substantially a rectangular U and extends into said waveguide a distance between about 0.1 inch and 0.25 inch from one of said narrow walls;

said iris extends a distance between about 0.40 inch and 0.52 inch in the direction which is parallel to the narrow walls and perpendicular to said elongated axis of said waveguide;

said legs are between about 0.35 inch and 0.47 inch long; and the gap between said legs is between about 0.04 and 0.1 inch.

8. An iris set for use in an elongated rectangular waveguide adapted for propagating waves along its elongated axis and comprising a pair of oppositely disposed, parallel broad walls spaced by a pair of oppositely disposed, parallel relatively narrower walls, each iris of said set extending through one of said narrower walls and being oriented transverse to the direction of propagation of said waves, said iris set comprising:

a connecting bar;

a plurality of U-shaped conductive irises, each having parallel legs which merge into a connecting base at one end, the other ends of said legs spaced by a gap;

said conductive irises spaced along said bar, each of said irises fixed to said bar along one of said iris's said legs so that when said iris is inserted in said waveguide through said narrow wall said base extends parallel to one of said broad walls and said other ends of said legs are adjacent to the other of said broad walls.

9. The iris set recited in claim 8 wherein each of said irises is substantially a rectangular U.

* * * * *